US009388764B2

(12) United States Patent
Laichinger et al.

(10) Patent No.: US 9,388,764 B2
(45) Date of Patent: Jul. 12, 2016

(54) VALVE COVER

(71) Applicant: ElringKlinger AG, Dettingen (DE)

(72) Inventors: Peter Laichinger, Laichingen (DE); Gerd Traxler, Weilheim Teck (DE)

(73) Assignee: ElringKlinger AG, Dettingen (DE)

( * ) Notice: Subject to any disclaimer, the term of this patent is extended or adjusted under 35 U.S.C. 154(b) by 5 days.

(21) Appl. No.: 14/185,015

(22) Filed: Feb. 20, 2014

(65) Prior Publication Data

US 2014/0230765 A1 Aug. 21, 2014

(30) Foreign Application Priority Data

Feb. 20, 2013 (DE) ..... 10 2013 202 762

(51) Int. Cl.
*F01M 9/10* (2006.01)
*F02F 7/00* (2006.01)

(52) U.S. Cl.
CPC ..... *F02F 7/0021* (2013.01); *F02F 7/0046* (2013.01); *F02F 7/0068* (2013.01)

(58) Field of Classification Search
CPC ..... F02F 7/0021; F02F 7/0046; F02F 7/0068
USPC ..... 123/90.38, 90.67
See application file for complete search history.

(56) References Cited

U.S. PATENT DOCUMENTS

| | | | | |
|---|---|---|---|---|
| 5,168,842 | A * | 12/1992 | Brooks | H01T 13/04 12/143 C |
| 5,335,641 | A | 8/1994 | Schnabel | |
| 5,499,502 | A | 3/1996 | Haniu et al. | |
| 7,631,630 | B2 * | 12/2009 | Sedlar | F02F 7/006 123/195 C |

FOREIGN PATENT DOCUMENTS

| | | |
|---|---|---|
| DE | 23 41 267 | 3/1975 |
| DE | 24 37 946 | 2/1976 |
| DE | 198 13 702 | 8/1999 |
| DE | 100 34 329 | 1/2002 |
| DE | 101 05 625 | 8/2002 |
| DE | 102 39 899 | 3/2004 |
| DE | 199 23 928 | 3/2008 |
| DE | 10 2006 035 296 | 2/2009 |
| DE | 10 2008 038 018 | 2/2010 |
| DE | 10 2008 038 020 | 2/2010 |
| DE | 10 2009 035 628 | 2/2010 |
| EP | 1 624 162 | 2/2006 |

* cited by examiner

*Primary Examiner* — Ching Chang
(74) *Attorney, Agent, or Firm* — Womble Carlyle Sandridge & Rice LLP

(57) ABSTRACT

In order to provide a valve cover to which at least one line is securable simply and by using a small number of fastening elements, it is proposed that the valve cover includes the following: a base body that, in the mounted condition of the valve cover, is arranged on an engine block of an internal combustion engine and covers over a valve chamber of the internal combustion engine, and at least one fixing device for securing at least one line to the base body of the valve cover, wherein the fixing device includes a fixing element and at least one fixing element receiver which is arranged on the base body and to which the fixing element is securable or secured by latching.

14 Claims, 15 Drawing Sheets

VALVE COVER

CROSS-REFERENCE TO RELATED APPLICATIONS

The present application claims the benefit of German application 10 2013 202 762.1 filed on Feb. 20, 2013, which is incorporated herein by reference in its entirety and for all purposes.

FIELD OF DISCLOSURE

The present invention relates to a valve cover, which includes a base body that, in the mounted condition of the valve cover, is arranged on an engine block of an internal combustion engine and covers over a valve chamber of the internal combustion engine.

A valve cover of this kind is known for example from DE 10 2008 038 020 A1.

SUMMARY OF THE INVENTION

The object of the present invention is to provide a valve cover to which at least one line is securable simply and by using a small number of fastening elements.

According to the invention, this object is achieved in that the valve cover includes the following:

- a base body that, in the mounted condition of the valve cover, is arranged on an engine block of an internal combustion engine and covers over a valve chamber of the internal combustion engine;
- at least one fixing device for securing at least one line to the base body of the valve cover, wherein the fixing device includes a fixing element and at least one fixing element receiver which is arranged on the base body and to which the fixing element is securable or secured by latching.

Because the valve cover includes at least one fixing device with which at least one fixing element is securable or secured by latching to at least one fixing element receiver, a line may be secured to the valve cover simply and by using a small number of fastening elements.

Preferably, the fixing element is releasably securable to at least one fixing element receiver.

In particular, it may be provided for the fixing element to be connectable or connected to at least one fixing element receiver in shape-locking manner and/or to engage behind at least one fixing element receiver.

A fixing device may for example take the form of a clipping device for clipping a fixing element, which takes the form of a clipping element, onto the base body of the valve cover.

Preferably, the base body is a thermoplastic part, in particular an injection moulded component.

It may be favorable if the fixing element is securable or secured to the base body, in particular to one or more fixing element receivers, exclusively by latching. Preferably, no additional or separate fastening elements such as screws are required to secure at least one fixing element to the at least one fixing element receiver.

It may be advantageous if the fixing element is securable or secured to a fixing element receiver rotatably or pivotally.

In particular, it may be provided for the fixing element to be securable or secured to a first fixing element receiver rotatably or pivotally and for the fixing element to be securable or secured, in particular being latchable or latched, to a second fixing element receiver by rotation or pivoting in relation to the first fixing element receiver.

For example, it may be provided for the fixing element to be movable from an open position to a closed position by rotation or pivoting in relation to the first fixing element receiver.

A line which is securable or secured to the base body of the valve cover by means of at least one fixing device is in particular an electrical line, gas line, fluid line and/or signal line. In particular, it may be provided for the line to be a high-pressure line, for example a common rail line for the injection of fuel.

It may be favorable if at least one fixing element receiver is molded within the base body.

At least one fixing element receiver is preferably formed by the shape of the base body.

In particular, it may be provided for at least one fixing element receiver and the base body to be formed in one piece with one another.

At least one fixing device is preferably movable without tools from an open position to a closed position, and/or from a closed position to an open position.

An open position of the fixing device is in particular a position of the fixing device in which a line is arrangeable on the base body or is removable from the base body.

A closed position of the fixing device is in particular a position of the fixing device in which the line is secured to the base body.

It may be favorable if at least one fixing device includes a locking device by means of which at least one fixing element of at least one fixing device is releasably securable or releasably secured in an open position. In this way, it is preferably possible to prevent the at least one fixing element from coming unintentionally out of the open position into a closed position and/or into an intermediate position between the open position and the closed position, as a result of which it could be made more difficult to arrange at least one line on the base body of the valve cover.

In an embodiment of the invention, it is provided for the base body to include a receiving portion which has a shape that is complementary, at least in certain regions and at least approximately, to the shape of a portion of the line.

In particular, it may be provided for the base body to include a receiving portion that is formed as a receiving channel, for receiving at least one portion of the line.

The receiving portion, in particular the receiving channel, of the base body is preferably molded within the base body of the valve cover.

Preferably, the receiving portion, in particular the receiving channel, of the base body is formed in one piece with the base body.

It may be provided for the receiving portion to be provided with an elastic material, at least in certain regions.

In particular, it may be provided for the receiving portion to be provided, in particular lined, with an abutment element of the base body, at least in certain regions.

The abutment element of the base body is preferably formed by an elastic material.

The abutment element of the base body may include recesses, raised portions and/or cutouts in order to enable simple adaptation of the abutment element of the base body to the shape of the line that is to be arranged in the receiving portion.

At least one fixing element of at least one fixing device preferably has a shape that is complementary, at least in certain regions and at least approximately, to the shape of a portion of the line.

In particular, it may be provided for at least one fixing element of at least one fixing device to include a bent portion and/or a curved portion.

Preferably, in the mounted condition of the valve cover and with the line secured, at least one fixing element of at least one fixing device abuts against the line over an extensive surface and not only at a point.

It may be favorable if at least one fixing element of at least one fixing device includes an elastic abutment element by means of which the at least one fixing element abuts against the line in the closed position. By means of an elastic abutment element of this kind, preferably a bias may be applied to the line and/or the at least one fixing element. As a result of this, a dynamic, in particular oscillating, load on the line and/or the fixing element is preferably reduced, as a result of which a longer service life of the line and/or the fixing element may be achieved.

It may be favorable if at least one fixing element includes one or more plastics materials or is formed of one or more plastics materials.

For example, it may be provided for at least one fixing element to be formed as a thermoplastic part, in particular an injection molded component.

As an alternative or in addition to this, it may be provided for at least one fixing element to include one or more metal materials or to be formed of one or more metal materials.

For example, it may be provided for at least one fixing element to include a bent plate product. In particular, it may be provided here for the bent plate product to be provided with an elastic abutment element, in particular formed of a plastics material.

It may be favorable if at least one fixing device includes a fixing element receiver which includes a rotation element that, together with a rotation element of a fixing element, forms a rotation device for rotary or pivotal securing of the fixing element to the fixing element receiver.

In particular, it may be provided for a rotation element to be formed as a shaft. A further rotation element is then preferably formed as a receiver for the shaft.

The rotation element formed as a shaft may for example be the rotation element of the fixing element receiver or the fixing element, while the rotation element formed as a receiver for the shaft is accordingly the rotation element of the fixing element or of the fixing element receiver respectively.

It may be advantageous if the fixing element receiver includes a support element on which the fixing element is supported in the closed position for transmitting a clamping force, in particular acting on the line. Preferably, the support element is an element of the fixing element receiver other than the rotation element.

The rotation element and the support element are preferably portions of the fixing element receiver and/or the fixing element that are different from one another.

In an embodiment of the invention, it is provided for at least one fixing element and/or at least one fixing element receiver to include a plurality of fixing portions by means of which the fixing element is arrangeable for receiving lines of different dimensions in different closed positions.

The valve cover may in particular be put in a pre-mounted condition in which at least one fixing element of at least one fixing device is arranged, in particular secured and/or locked, on the base body in the open position. A line may then simply be laid in a receiving portion of the base body. Preferably, simply pivoting or rotating the at least one fixing element of the at least one fixing device may put and latch the at least one fixing element of the at least one fixing device in the closed position in order to secure the line to the valve cover.

In an alternative embodiment, it may be provided for at least one fixing element of at least one fixing device to be threadable into a fixing element receiver and, by being rotated or pivoted about this fixing element receiver, to be latchable to a further fixing element receiver.

It may be advantageous if, when the fixing element is it its closed position, it spans the line and/or at least partly surrounds it.

The valve cover according to the invention may further have one or more of the features described below:

Preferably, a line is receivable and securable by means of a bearing shell device.

The bearing shell device may for example include a lower bearing shell, which is in particular a component part of the base body, and an upper bearing shell, which is in particular at least one fixing element of at least one fixing device.

It may be provided for at least one fixing element to be arrangeable on two sides of the base body. Preferably, for this purpose the base body includes two fixing element receivers for each fixing element.

It may be provided for the fixing element to be latchable to a fixing element receiver on only one side.

The other side of the fixing element is preferably threaded into an undercut in the base body or secured to the base body in another way.

For variable line diameters, it is possible to provide latching by means of a plurality of steps.

The valve cover according to the invention preferably has a smaller mass than conventional valve covers.

Preferably, the valve cover according to the invention occupies a smaller overall volume than conventional valve covers. In particular, high domes for inserts or sleeves and screws in the valve cover for fixing lines may be dispensed with.

At least one fixing element of at least one fixing device may for example take the form of a bracket device, in particular a plastics bracket device.

It may be favorable if the fixing element and the fixing element receiver are formed such that in the event of overload, in particular a mechanical overload, of the connection between the at least one line and the base body of the valve cover, the fixing element fails.

For this purpose, the fixing element is provided for example with a weak point and/or a triggering device for the controlled failure of the fixing element in the event of overload.

The fixing element and the fixing element receiver are preferably formed and/or configured such that, in the absence of deliberate unlocking (release of the latching), the line which is secured to the base body of the valve cover by means of the fixing element is removable from the base body only by destroying the fixing element.

Because the fixing element is preferably the first element to fail in the event of overload, it is possible to repair the valve cover particularly simply—that is to say to return it to an initial condition—by simply replacing the fixing element by a new fixing element.

It may be provided for the fixing element to be guidable along an inner side, facing the line, of a latching element of a fixing element receiver so that it can be latched to the latching element. With an inside arrangement of the fixing element of this kind, there may be a risk that the fixing element will be deformed in the event of a load on the connection between the line and the base body of the valve cover. The latching between the fixing element and the fixing element receiver may be released as a result.

Preferably, the fixing element thus includes a stop element which is in particular formed to be inelastic. By means of the stop element, the fixing element may for example be brought into abutment against the line such that in the closed position the fixing element is not movable towards the line and hence the latching between the fixing element and the fixing element receiver cannot be released.

In principle, the stop element may be arranged on the fixing element.

However, it may also be provided for the stop element to be a component part of the base body of the valve cover or a component part of a fixing element receiver.

Further preferred features and/or advantages of the invention will be discussed in the description below and the illustrative drawing of exemplary embodiments.

BRIEF DESCRIPTION OF THE DRAWINGS

Like or functionally equivalent elements are provided with the same reference numerals in all the figures.

DETAILED DESCRIPTION OF THE DRAWINGS

Figure 1:
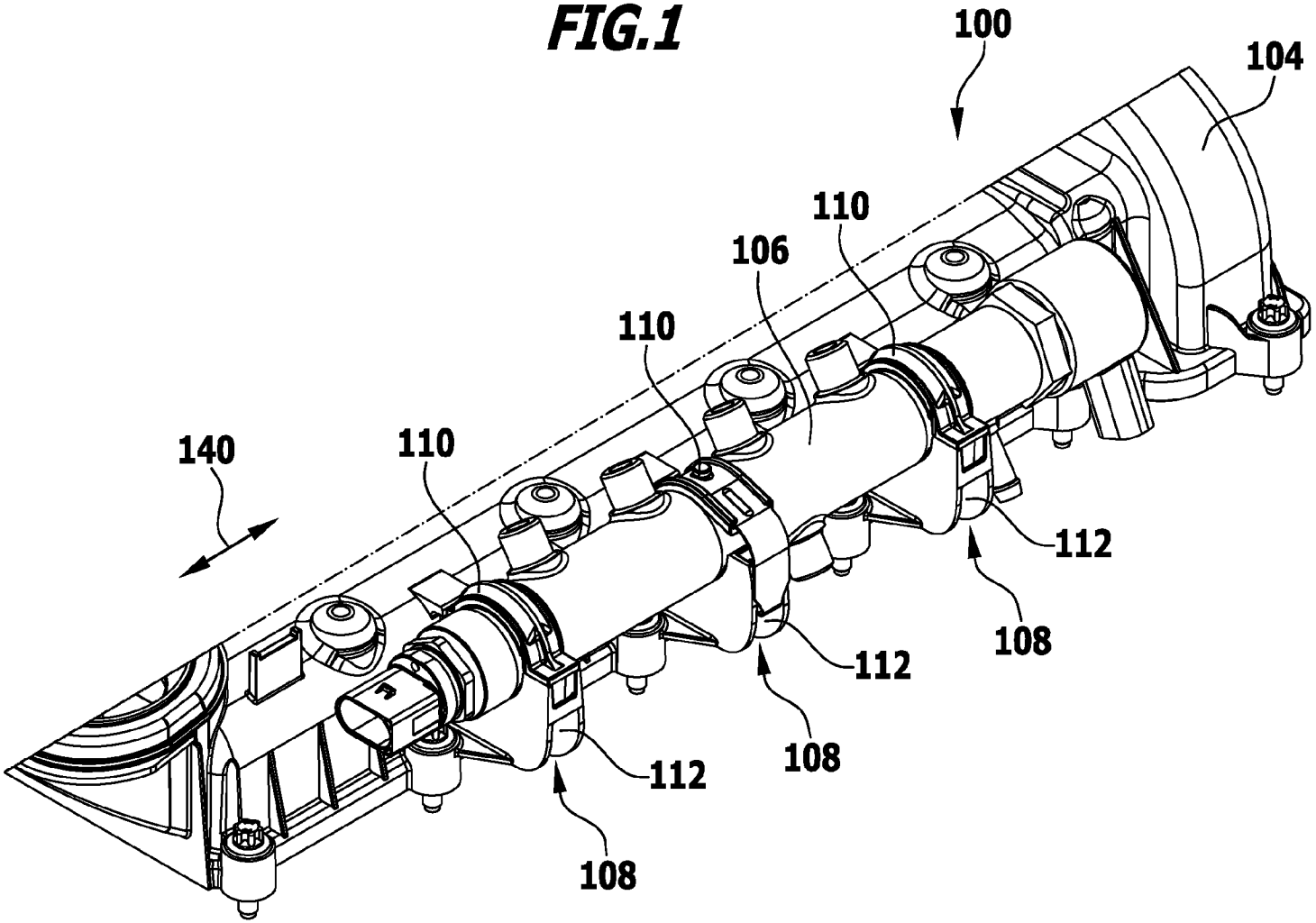
FIG. 1 shows a schematic illustration of part of a first embodiment of a valve cover in which a line is secured to a base body of the valve cover by means of three fixing devices.

A first embodiment, illustrated in FIGS. 1 to 6, of a valve cover which is designated 100 overall serves to cover over a valve chamber 102 of an internal combustion engine (not illustrated) and for this purpose is arranged, in the mounted condition of the valve cover 100, on an engine block (not illustrated) of the internal combustion engine.

In particular, the valve cover 100 includes a base body 104 which is formed for example by a plastics material as an injection molded component. Preferably, the base body 104 covers over the valve chamber 102 of the internal combustion engine.

Preferably, one or more lines 106 are arranged, in particular fixed, on the valve cover 100.

A line 106 may for example be an electrical line, gas line, fluid line and/or signal line.

In particular, it may be provided for the line 106 to be a common rail line.

The line 106 may for example be secured to the base body 104 of the valve cover 100 by means of screw connections (not illustrated).

Preferably, however, the line 106 is secured by means of fixing devices 108 of the types illustrated in the figures.

Each fixing device 108 includes a fixing element 110 and two fixing element receivers 112 arranged on the base body 104, in particular a first fixing element receiver 112*a* and a second fixing element receiver 112*b*.

The fixing element 110 is securable to the fixing element receivers 112 in particular at end regions 114 of the fixing element 110.

The fixing element 110 preferably includes a first end region 114*a*, which is associated with the first fixing element receiver 112*a*, and a second end region 114*b*, which is associated with the second fixing element receiver 112*b*.

Figure 3:
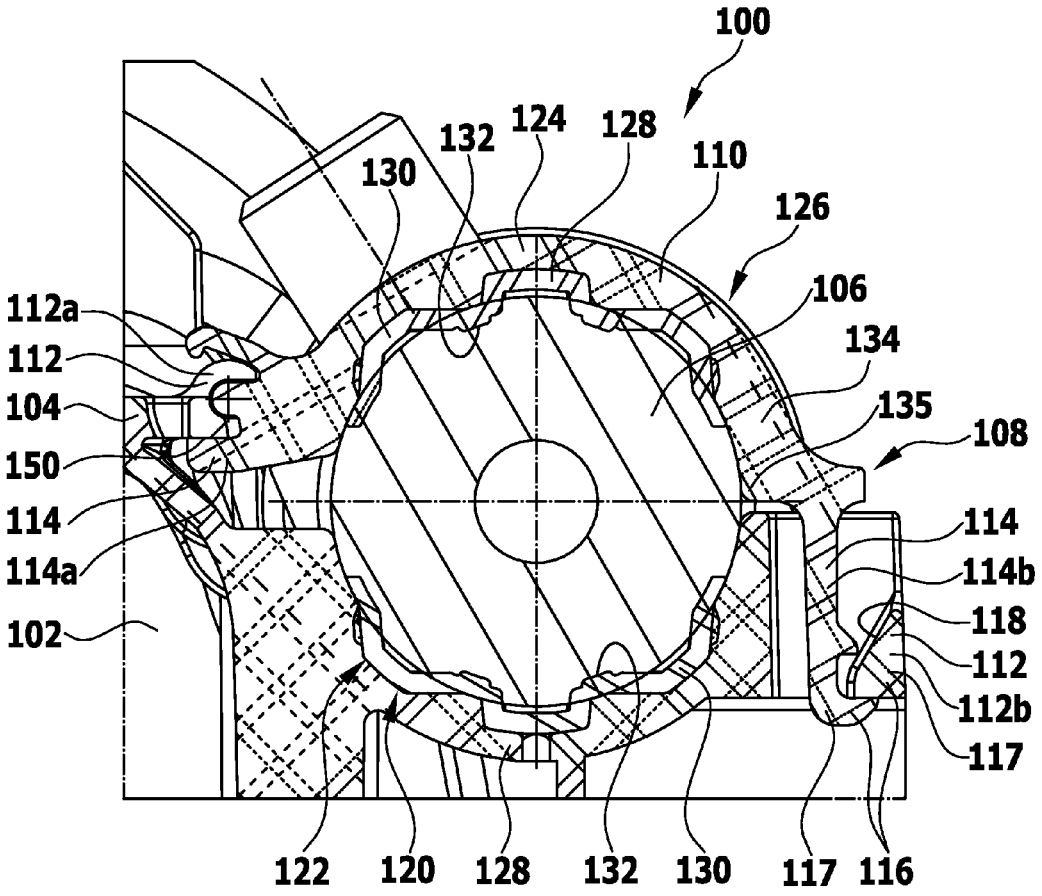
FIG. 3 shows a schematic cross section through a first fixing device of the valve cover from FIG. 1 and the line that is secured by means of this fixing device, wherein a fixing element of the fixing device is arranged in a closed position.
Figure 4:
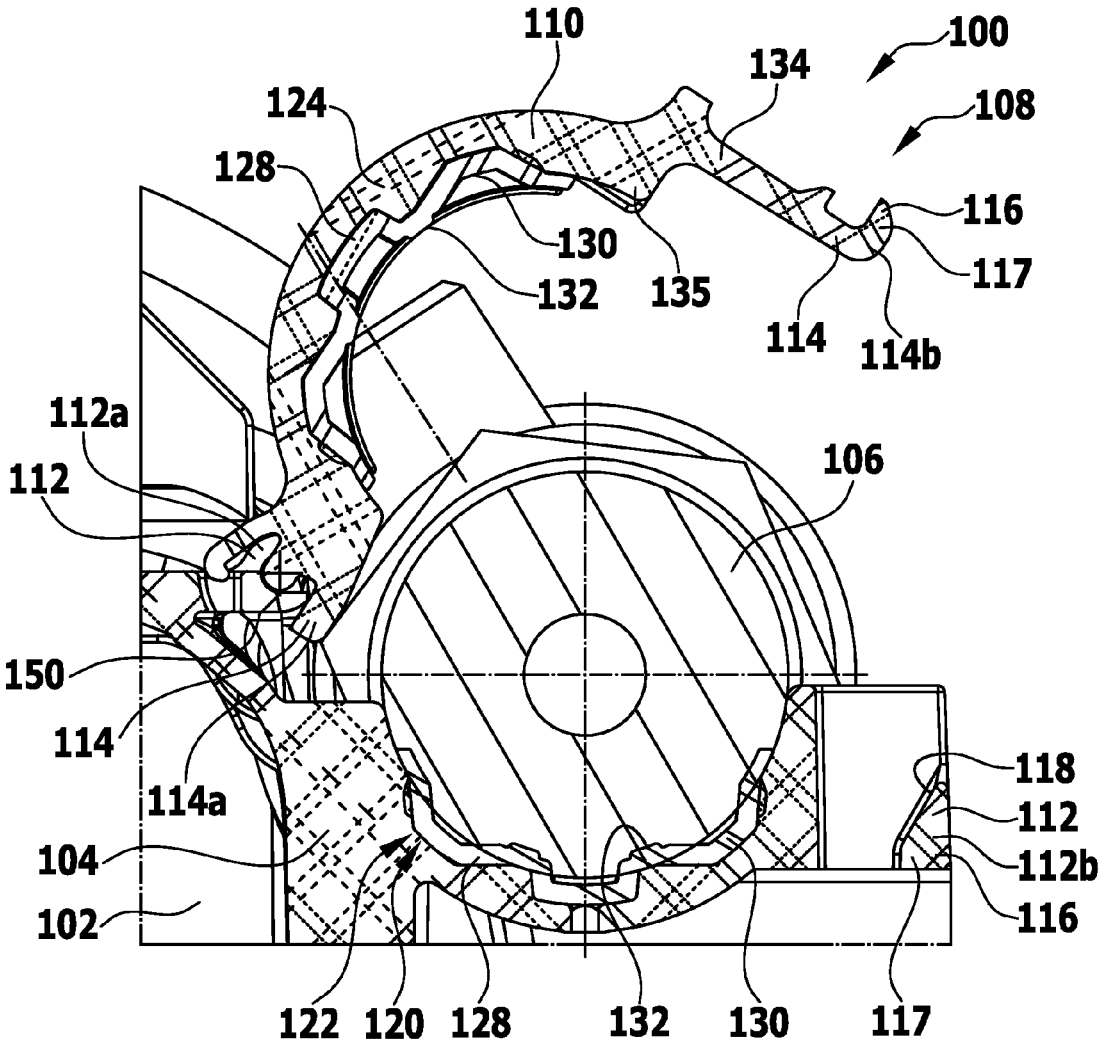
FIG. 4 shows a schematic illustration, corresponding to FIG. 3, of the fixing device from FIG. 3, wherein the fixing element is arranged in an open position.

In the embodiment of the fixing device 108 that is illustrated in FIGS. 3 and 4, it is provided for the first end region 114*a* to be threadable into the first fixing element receiver 112*a*, for the purpose of securing the fixing element 110 to the base body 104 of the valve cover 100.

As a result of a rotary or pivotal movement of the fixing element 110 in relation to the first fixing element receiver 112*a*, the second end region 114*b* is engageable with the second fixing element receiver 112*b*. The fixing element 110 is in this case moved out of the open position illustrated in FIG. 4, into the closed position illustrated in FIG. 3.

The second end region 114*b* and the second fixing element receiver 112*b* are latchable to one another. For this purpose, both the fixing element 110 and the second fixing element receiver 112*b* respectively have one or more latching elements 116 which form fixing portions 117 of the fixing device 108.

The fixing element 110 is preferably formed to be flexible such that in particular the latching element 116 of the fixing element 110 is movable past a rigidly formed latching element 116 of the fixing element receiver 112*b*, in order to engage behind it in latching manner.

It may be provided for the second end region 114*b* of the fixing element 110 to be guidable past the latching element 116 of the second fixing element receiver 112*b* on an inner side 118, facing the line 106, of the latching element 116 of the second fixing element receiver 112*b*, in order to latch the second end region 114*b* of the fixing element 110 to the second fixing element receiver 112*b*.

The base body 104 of the valve cover 100 includes a receiving portion 120 for receiving the line 106.

The receiving portion 120 is preferably formed to be at least approximately complementary to a portion of the line 106, such that the line 106 may be received securely and reliably.

The receiving portion 120 is formed for example as a receiving channel 122.

Preferably, the fixing element 110 is also formed to be complementary, at least in certain regions, to a portion of the line 106, in order to be able to receive the line 106 securely and reliably.

For this purpose, the fixing element 110 includes for example a bent or curved portion 124 by means of which the fixing element 110 at least partly spans the line 106 and/or surrounds it.

The first fixing element receiver 112*a* and the second fixing element receiver 112*b*, as well as the first end region 114*a* and the second end region 114*b* of the fixing element 110, are preferably arranged on mutually opposite sides of the receiving channel 122 of the base body 104 and/or the bent or curved portion 124 of the fixing element 110.

Preferably, a substantially annular bordering portion 126 for the line 106 is formed by means of the receiving channel 122 of the base body 104 and the fixing element 110.

It may be favorable if the base body 104, in particular the receiving portion 120 of the base body 104, and/or the fixing element 110, in particular the bent or curved portion 124 of the fixing element 110, includes an abutment element 128.

By means of an abutment element 128 of this kind, which is preferably formed to be elastic, being for example formed by a rubber material, a bias may preferably be applied to the line 106 and/or the fixing device 108. As a result of this, the line 106 is securely fixable in the fixing device 108. At the same time, a dynamic load during operation of the internal combustion engine is preferably pronouncedly reduced.

For simple adaptation of the one abutment element 128 or the plurality of abutment elements 128 to the shape and/or the dimensions of the line 106, it may be provided for the abutment element 128 or abutment elements 128 to be provided with recesses 130 and/or projections 132.

In the embodiment of the fixing device 108 that is illustrated in FIGS. 3 and 4, the fixing element 110 includes an injection molded component 134 which is made from a plastics material and includes the first end region 114*a*, the bent or curved portion 124 and the second end region 114*b*.

The abutment element 128 is arranged on the injection molded component 124 as an additional element.

As can be seen in particular from FIG. 3, the fixing element 110 includes a stop element 135 by means of which the fixing element 110 abuts against the line 106 in the closed position.

The stop element 135 may for example be formed as a projection on the fixing element 110.

In other embodiments (not illustrated), it may be provided for the stop element 135 to be a component part of a fixing element receiver 112 or the base body 104.

The stop element 135 serves in particular to prevent movement of the fixing element 110 in the direction of the line 106 when the connection between the line 106 and the base body 104 of the valve cover 100 is under high load.

In particular, by means of the stop element 135 it is preferably possible to prevent the second end region 114*b* of the fixing element 110 from being deformed by a movement in the direction of the line 106 and hence the latching of the fixing element 110 to the second fixing element receiver 112*b* from being released.

Thus, by means of the stop element 135 it is possible in particular to effectively prevent undesirable opening of the fixing device 108.

Figure 2:
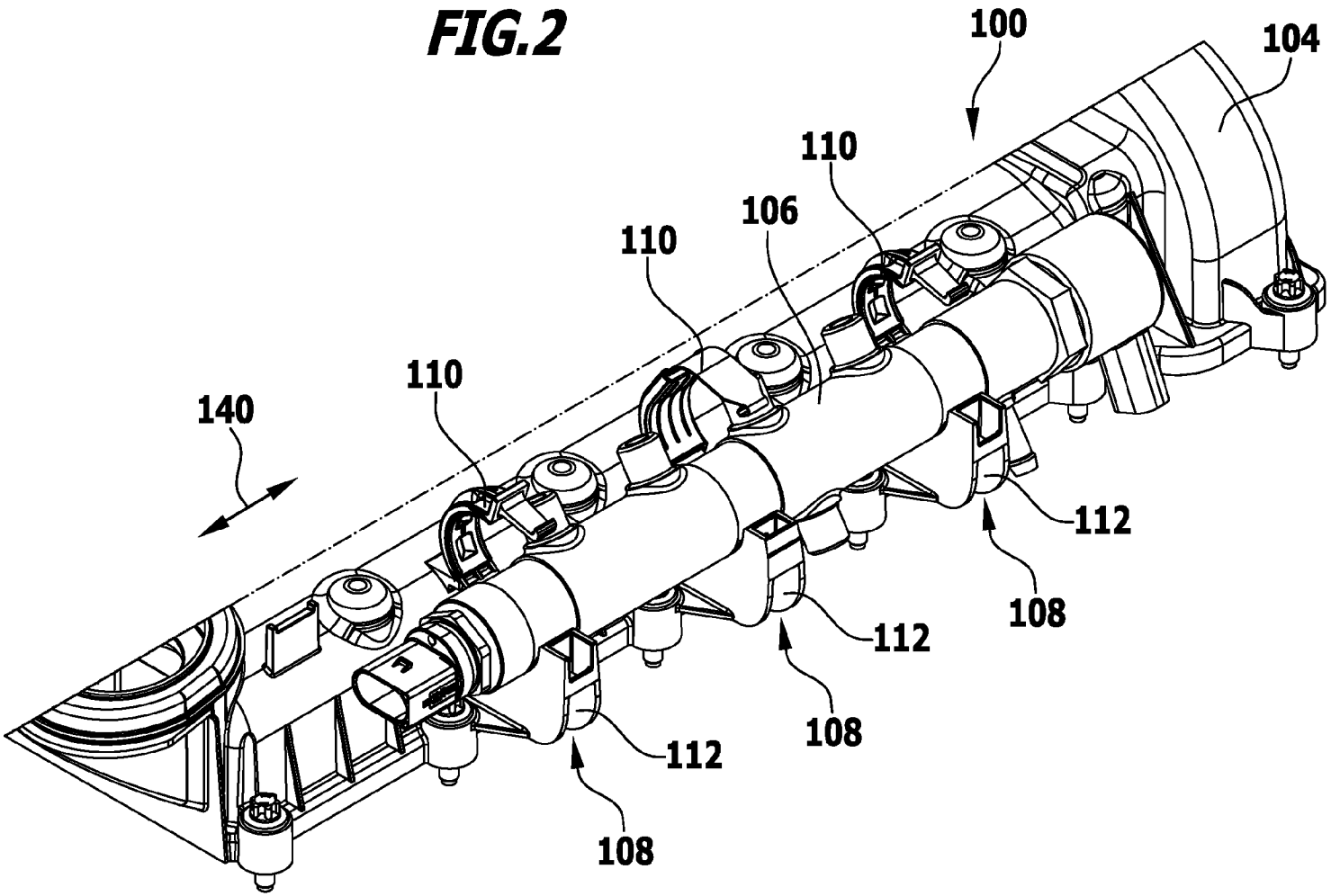
FIG. 2 shows a schematic illustration, corresponding to FIG. 1, of the valve cover, wherein the fixing devices are arranged in an open position in which the line may be arranged on the base body or removed from the base body.
Figure 5:
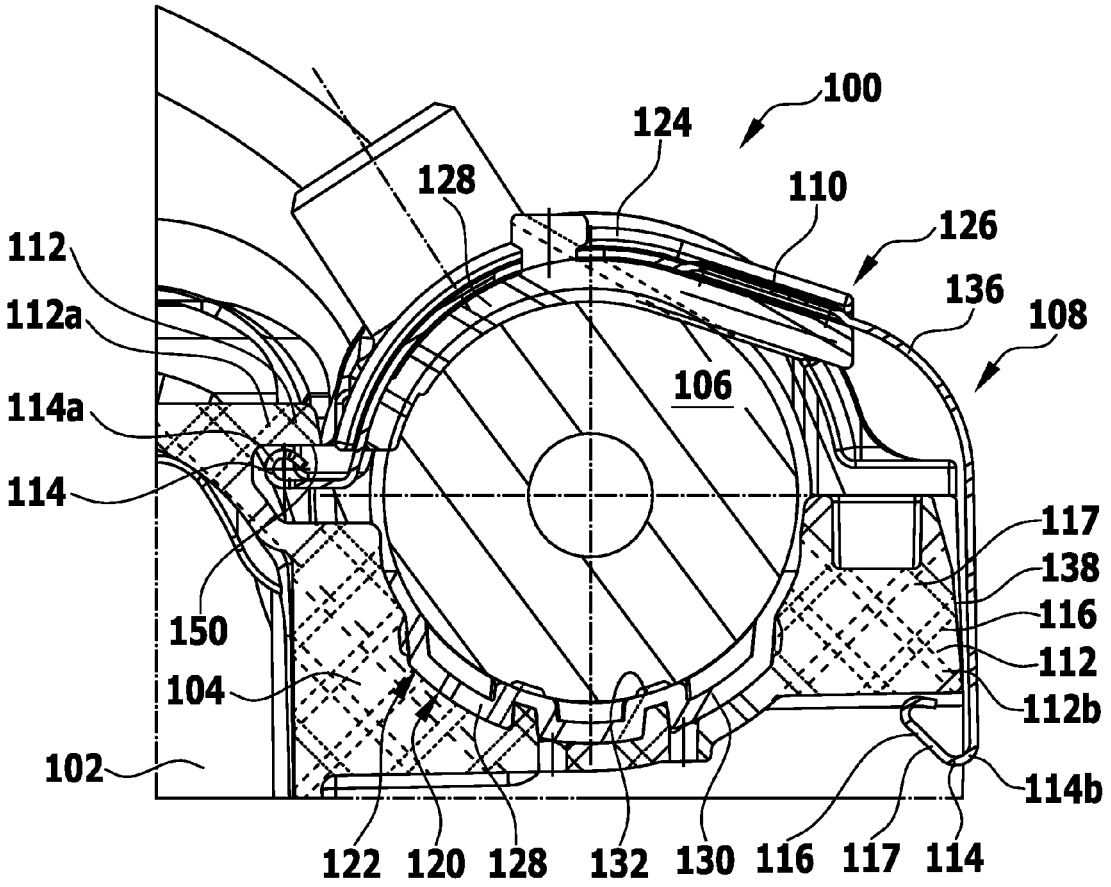
FIG. 5 shows a schematic cross section, corresponding to FIG. 3, through a second embodiment of a fixing device of the valve cover from FIG. 1, wherein a fixing element of the fixing device includes a metal bracket and is arranged in a closed position.
Figure 6:
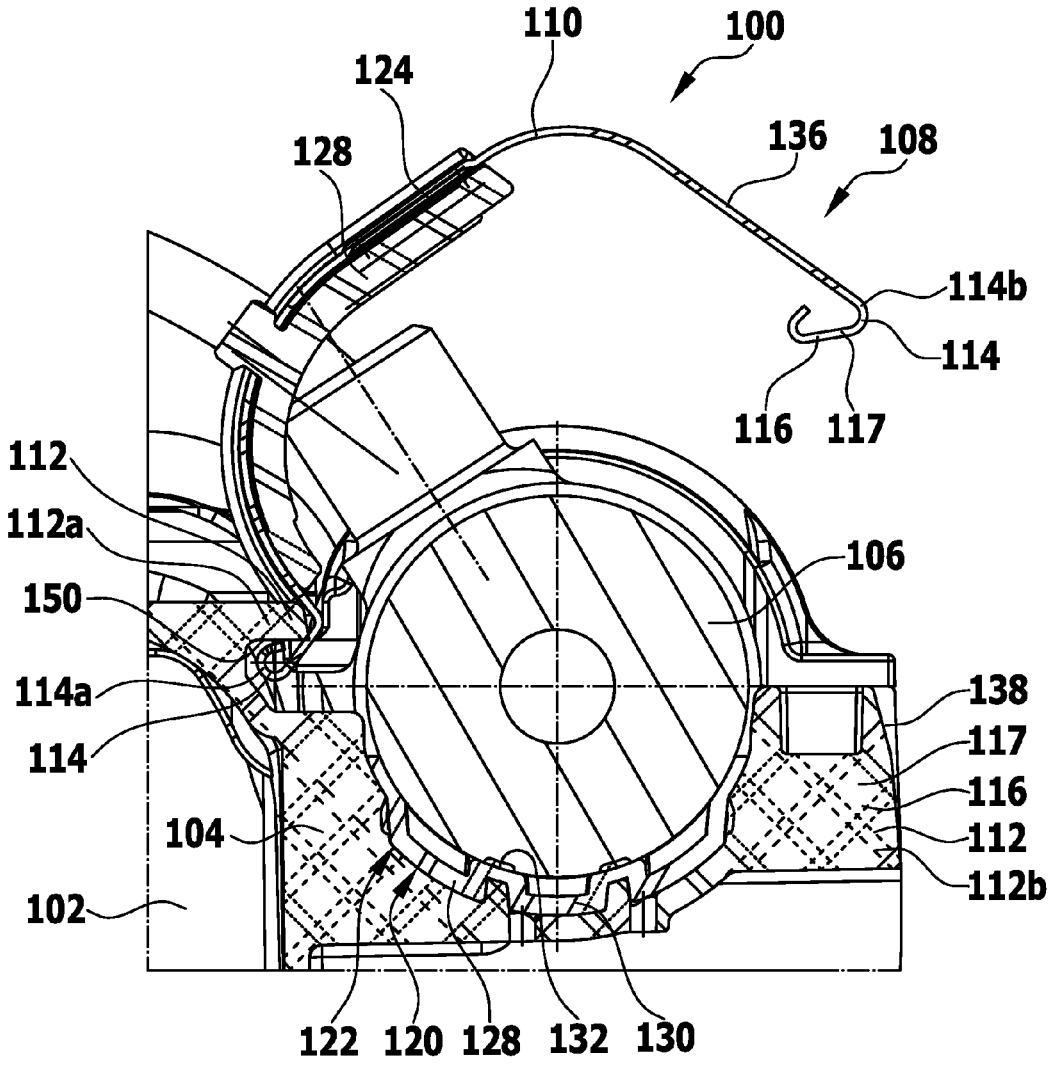
FIG. 6 shows a schematic cross section, corresponding to FIG. 5, through the fixing device from FIG. 5, wherein the fixing element is arranged in the open position.

In the case of an alternative embodiment, illustrated in FIGS. 5 and 6, of a fixing device 108 which in accordance with FIGS. 1 and 2 is provided, in addition to the fixing device 108 from FIGS. 3 and 4, in the first embodiment of the valve cover 100 illustrated in FIGS. 1 and 2, the fixing element 110 is formed by a metal bracket 136 and, arranged thereon, an abutment element 128 made from an elastic material.

As can be seen in particular from the closed position illustrated in FIG. 5 of the fixing device 108, in particular the fixing element 110, the embodiment of the fixing device 108 that is illustrated in FIGS. 5 and 6 moreover differs from the embodiment of the fixing device 108 illustrated in FIGS. 3 and 4 in that the fixing element 110 is guidable along an outer side 138 of the latching element 116 of the second fixing element receiver 112*b* in order to latch the second end region 114*b* of the fixing element 110 to the second fixing element receiver 112*b*.

The outer side 138 is in this case in particular a side of the latching element 116 of the second fixing element receiver 112*b* that is remote from the line 106.

Otherwise, the embodiment of the fixing device 108 that is illustrated in FIGS. 5 and 6 corresponds in respect of its construction and function to the embodiment illustrated in FIGS. 3 and 4, so reference is made to the description thereof above for these.

As can be seen in particular from FIGS. 1 and 2, in the case of the first embodiment of the valve cover 100 both a fixing device 108 according to the embodiment illustrated in FIGS. 3 and 4 and a fixing device 108 according to the embodiment illustrated in FIGS. 5 and 6 may be provided.

In particular, in the case of the first embodiment of the valve cover 100 that is illustrated in FIGS. 1 and 2, three fixing devices 108 are provided for fixing a line 106.

In this case, the fixing devices 108 are arranged one behind the other and spaced from one another, as seen in the longitudinal direction 140 of the line 106.

Here, a fixing device 108 according to the embodiment illustrated in FIGS. 5 and 6 is arranged between two fixing devices 108 according to the embodiment illustrated in FIGS. 3 and 4.

In principle, however, another number or arrangement of fixing devices 108 may also be provided for fixing the line 106. Further, it may be provided for all the fixing devices 108 of a valve cover 100 to be substantially identical, for example to be formed according to the embodiment illustrated in FIGS. 3 and 4 or according to the embodiment illustrated in FIGS. 5 and 6.

The first embodiment of the valve cover 100, which is illustrated in FIGS. 1 to 6, functions as follows:

In an initial condition of the valve cover 100, neither the fixing elements 110 nor the line 106 are arranged on the base body 104.

To secure the line 106 to the base body 104, the line is laid in the receiving portion 120, in particular the receiving channel 122, of the base body 104.

Then the fixing elements 110 of the fixing devices 108 are arranged on the base body 104.

For this purpose, the fixing elements 110 are threaded into the first fixing element receivers 112*a* by means of the first end regions 114*a*.

Then the fixing elements 110 are pivoted or rotated in relation to the first fixing element receivers 112*a* such that the second end region 114*b* of each fixing element 110 moves towards the respective second fixing element receiver 112*b* and finally latches with it. In particular, as a result of the pivotal movement of the fixing element 110 in relation to the first fixing element receiver 112*a*, the latching element 116 of the fixing element 110 is guided past the latching element 116 of the second fixing element receiver 112*b* and engages behind the latching element 116 of the second fixing element receiver 112*b* to make a shape-locking latching connection.

As a result of this securing of the fixing elements 110 to the base body 104, the line 106 is clamped between the fixing element 110 and the receiving portion 120 of the base body 104.

Here, reliable fixing of the line 106 is in particular achieved by means of the abutment elements 128, which adjust to the shape and/or dimensions of the line 106 as a result of their elastic properties.

It is clear from the foregoing that the line 106 is securable to the base body 104 of the valve cover 100 exclusively by means of the fixing elements 110 and without the aid of a tool.

Further, the line 106 is also removable again without tools, in that the latching connection between the second end region 114*b* of the fixing element 110 and the second fixing element receiver 112*b* is released and the fixing element 110 is moved from the closed position illustrated in FIGS. 3 and 5 to the open position illustrated in FIGS. 4 and 6.

A second embodiment of a valve cover 100, illustrated in FIGS. 7 to 10, differs from the first embodiment illustrated in FIGS. 1 to 6 substantially in that one or more fixing devices 108 include a rotation device 142 by means of which the fixing element 110 is arranged, particularly on bearings, rotatably or pivotally on the base body 104.

The fixing element 110 and the base body 104 each include a rotation element 144 of the rotation device 142.

For example, it may be provided for a rotation element 144 to be formed as a shaft 146 or a shaft part. Further, it may be provided for a rotation element 144 to be formed as a shaft receiver 148.

In the second embodiment of the valve cover 100 that is illustrated in FIGS. 7 to 10, it is provided for the rotation element 144 of the base body 104 to be formed as a shaft receiver 148 and to form a component part of the first fixing element receiver 112*a*.

The rotation element 144 arranged on the first end region 114*a* of the fixing element 110 is formed as a shaft 146.

In this way, the fixing element 110 is rotatably or pivotally securable to the base body 104.

Figure 7:
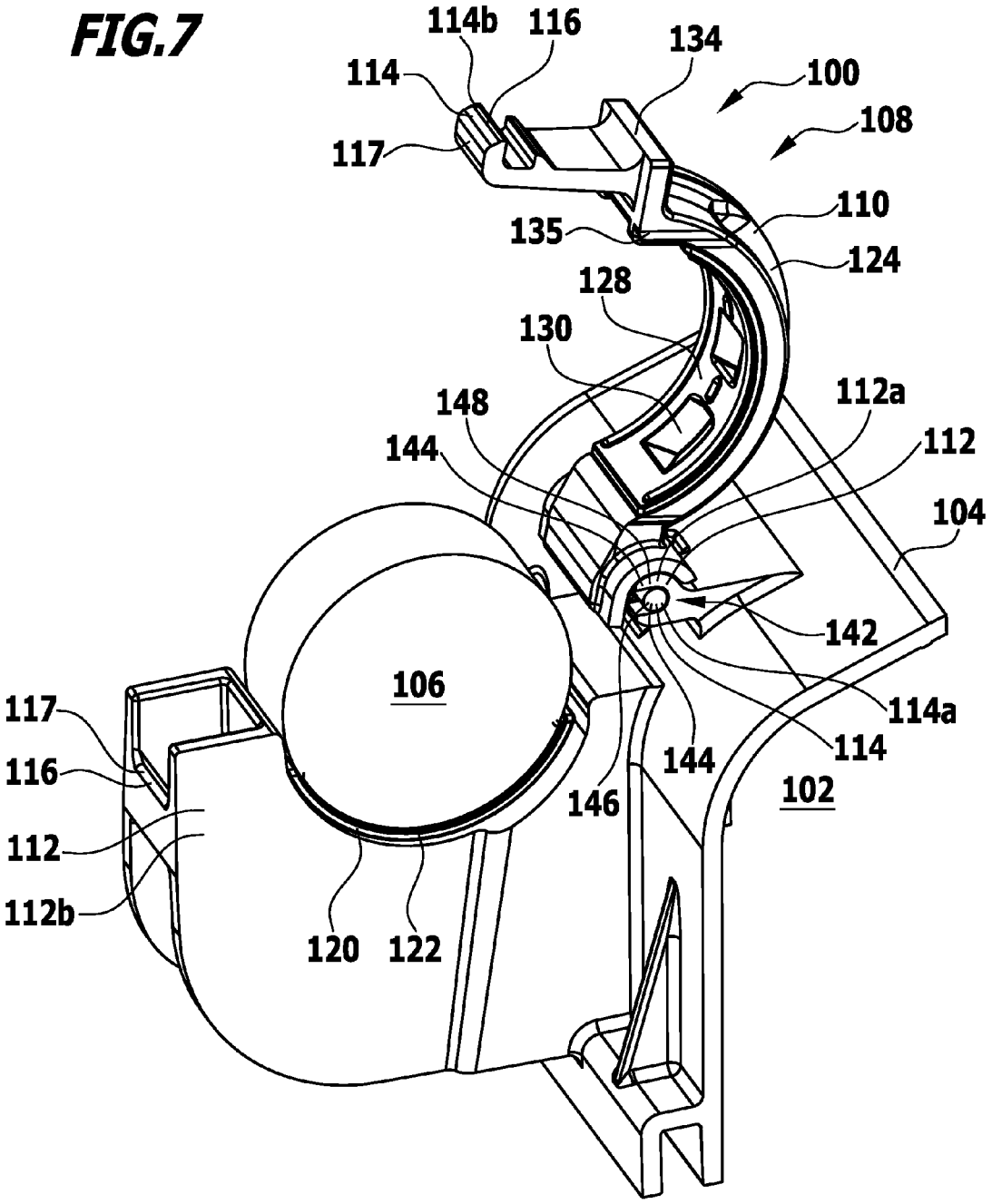
FIG. 7 shows a schematic perspective illustration of a second embodiment of a valve cover, in which a rotation device is provided for rotatably or pivotally securing the fixing element to a fixing element receiver, wherein the fixing element is arranged in an open position.
Figure 8:
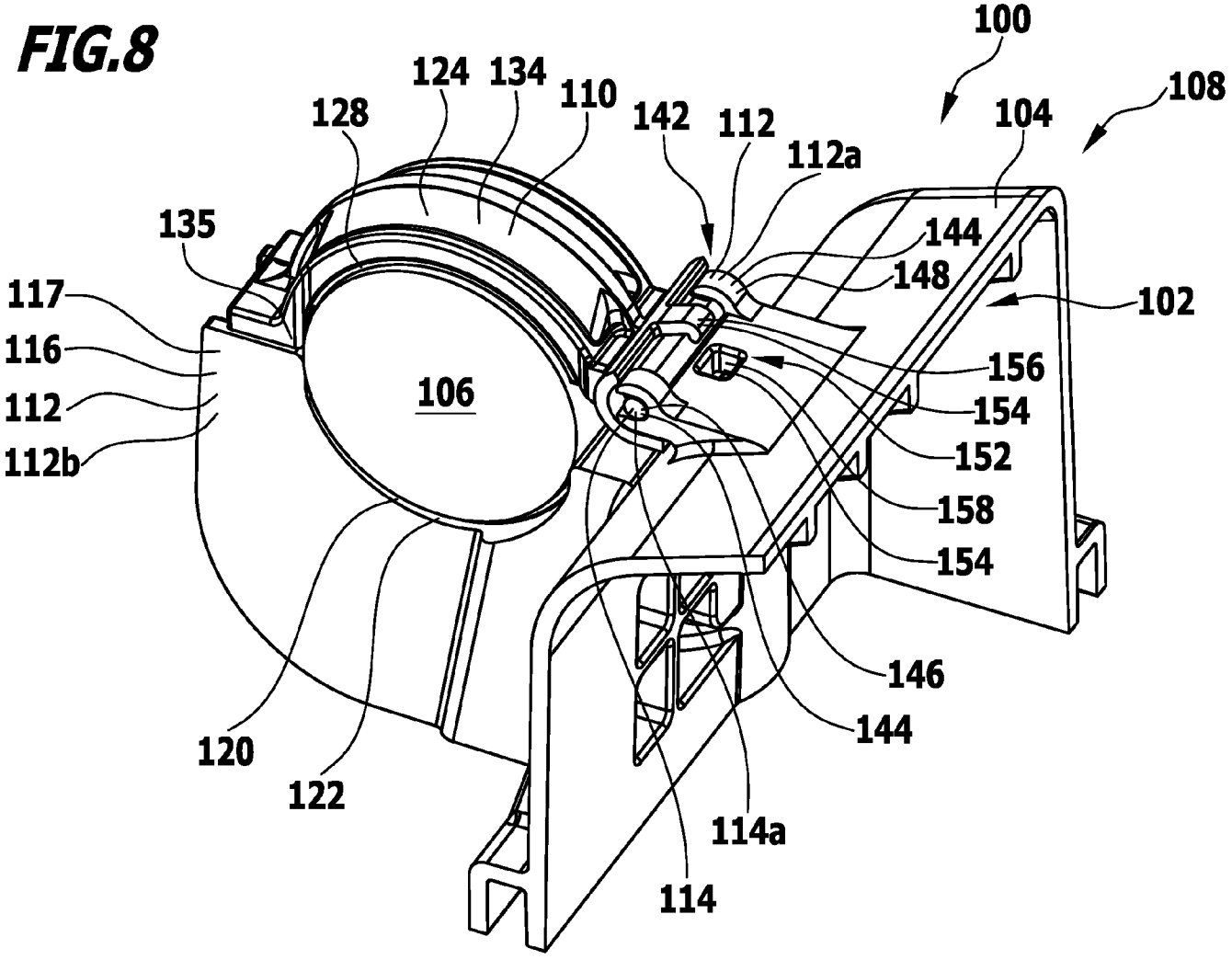
FIG. 8 shows a schematic perspective illustration of the second embodiment of the valve cover from FIG. 7, wherein the fixing element is arranged in a closed position.
Figure 9:
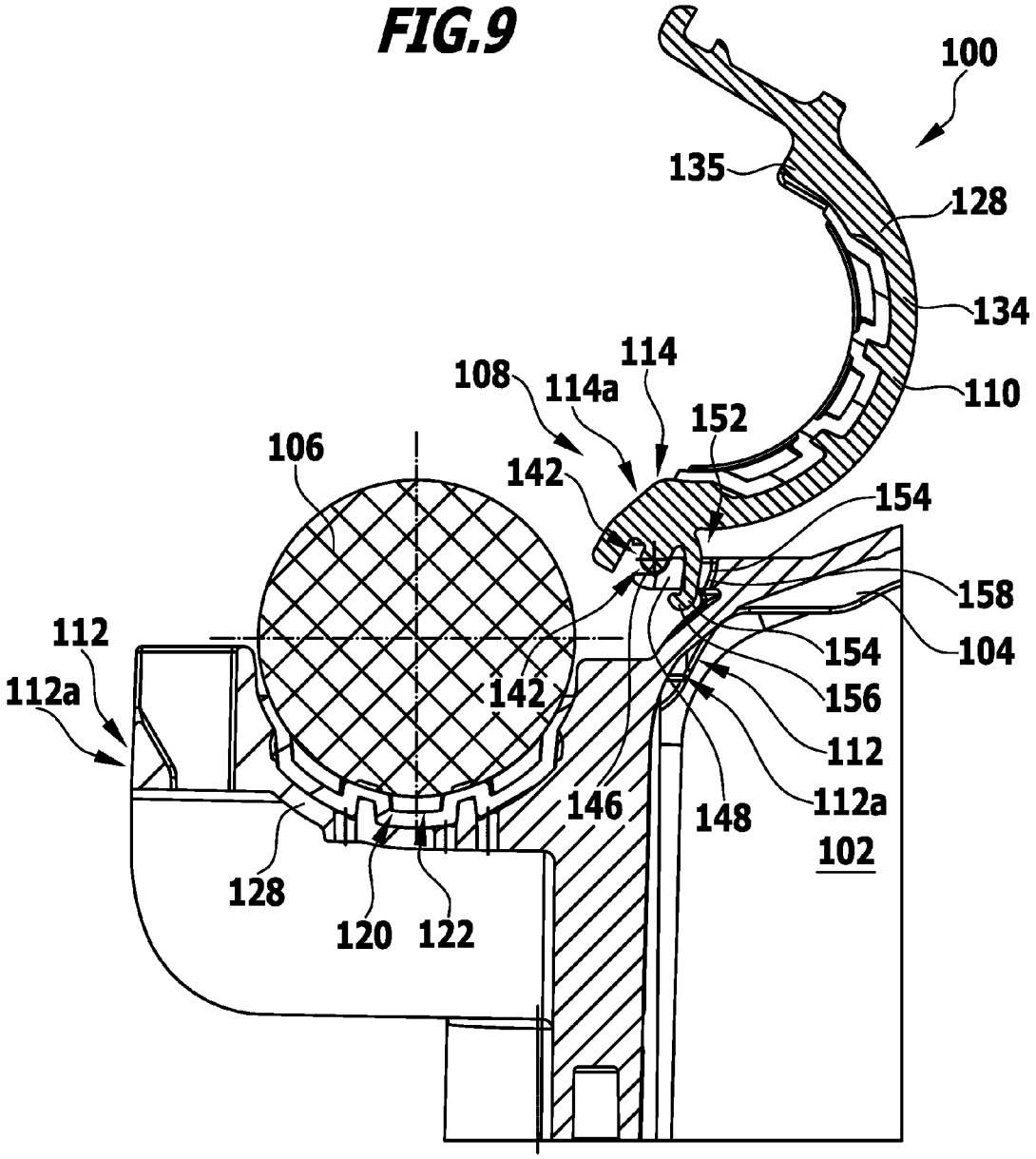
FIG. 9 shows a cross section, corresponding to FIG. 3, through the fixing device of the valve cover in FIG. 7, wherein the fixing element is arranged in an open position.
Figure 10:
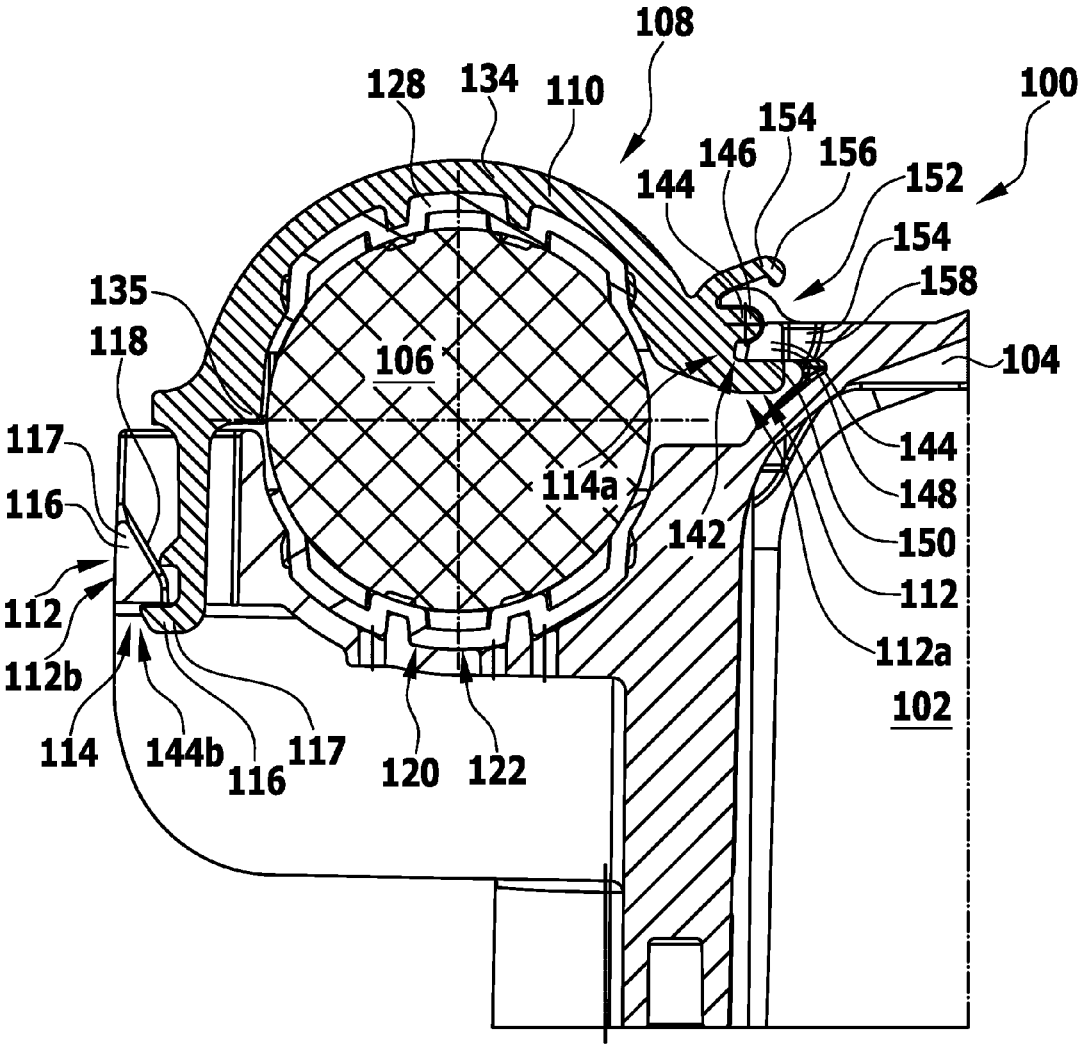
FIG. 10 shows a sectional illustration, corresponding to FIG. 9, of the fixing device of the second embodiment of the valve cover, wherein the fixing element is arranged in the closed position.

In particular, the fixing element 110 is movable from the open position that is illustrated in FIGS. 7 and 9 to the closed position that is illustrated in FIGS. 8 and 10, and from the closed position to the open position.

As can be seen in particular from FIG. 10, the fixing device 108, in particular the base body 104, includes a support element 150 on which the fixing element 110 is supported in the closed position.

Preferably, the support element 150 is an element other than the rotation element 144 and/or a portion of the base body 104 other than the rotation element 144.

Because forces which occur in the first end region 114*a* of the fixing element 110 can be taken up and transmitted by means of the support element 150, the rotation device 142 can be relieved of load in the closed position.

As can be seen in particular from FIGS. 8 and 9, in the second embodiment of the valve cover 100 that is illustrated in FIGS. 7 to 10 the fixing device 108 includes a locking device 152 by means of which the fixing element 110 is lockable in the open position illustrated in FIGS. 7 and 9.

Here, it is preferably provided for the fixing element 110 and/or the base body 104, in particular the first fixing element receiver 112*a*, (each) to have a locking element 154.

For example, it may be provided for the fixing element 110 to include a locking projection 156 which can cooperate with a locking opening 158 in the base body 104, in particular in the region of the first fixing element receiver 112*a*, in order to lock the fixing element 110 in the open position.

The fixing element 110 that is illustrated in FIGS. 7 to 10 is in particular an injection molded component 134 according to the embodiment of a fixing device 108 illustrated in FIGS. 3 and 4.

The rotation element 144 of the fixing element 110 and/or the locking element 154 of the fixing element 110 are preferably formed in one piece with the bent or curved portion 124, the first end region 114*a* and the second end region 114*b* of the fixing element 110.

The rotation element 144 of the base body 104 and/or the locking element 154 of the base body 104 are preferably molded within the base body 104 and/or formed in one piece with the base body 104.

In particular, it may be provided for the fixing element 110 to be releasably connectable or connected to the base body 104 by means of the rotation device 142.

Otherwise, the second embodiment of the valve cover 100 that is illustrated in FIGS. 7 to 10 corresponds regarding its construction and function to the first embodiment illustrated in FIGS. 1 to 6, so reference is made to the description thereof above in this respect.

Figure 11:
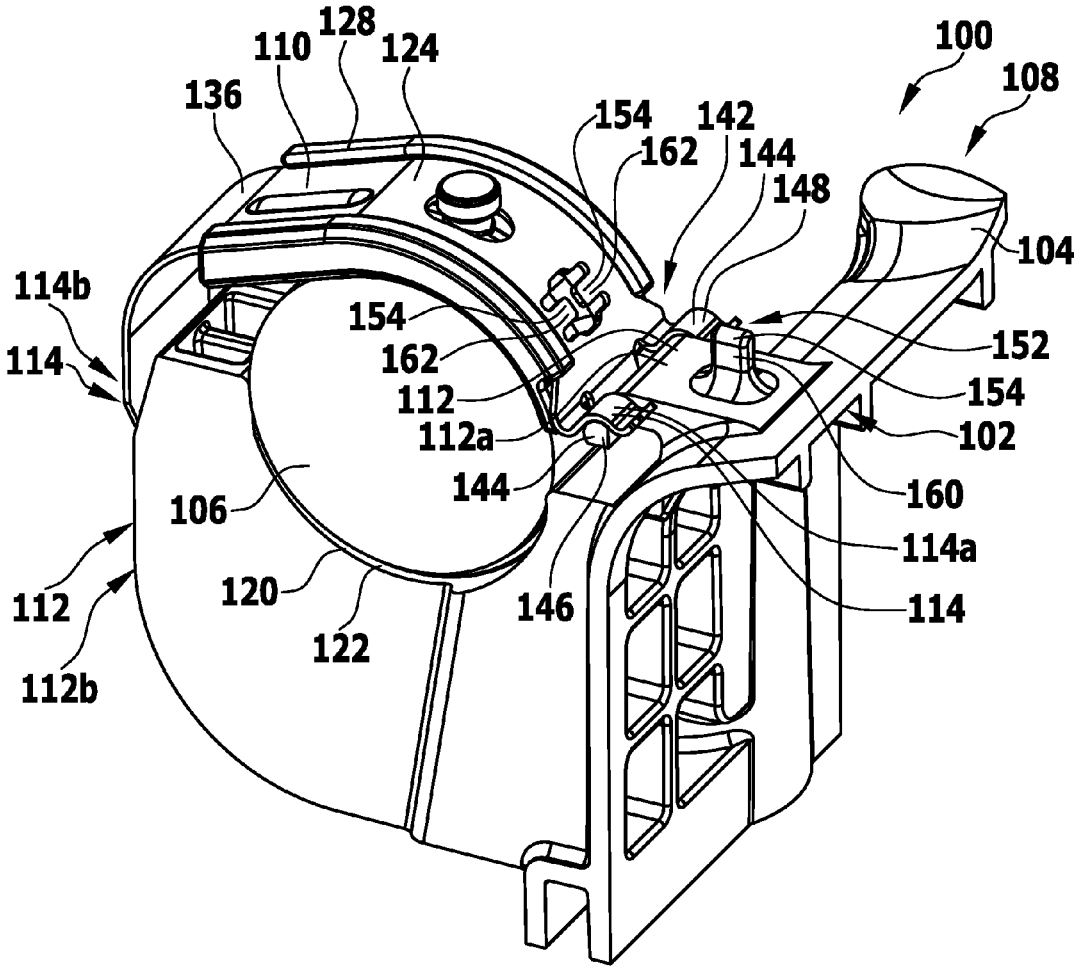
FIG. 11 shows a schematic perspective illustration of a fixing device of a third embodiment of the valve cover, wherein a fixing element of the fixing device includes a metal bracket and is arranged in a closed position.
Figure 12:
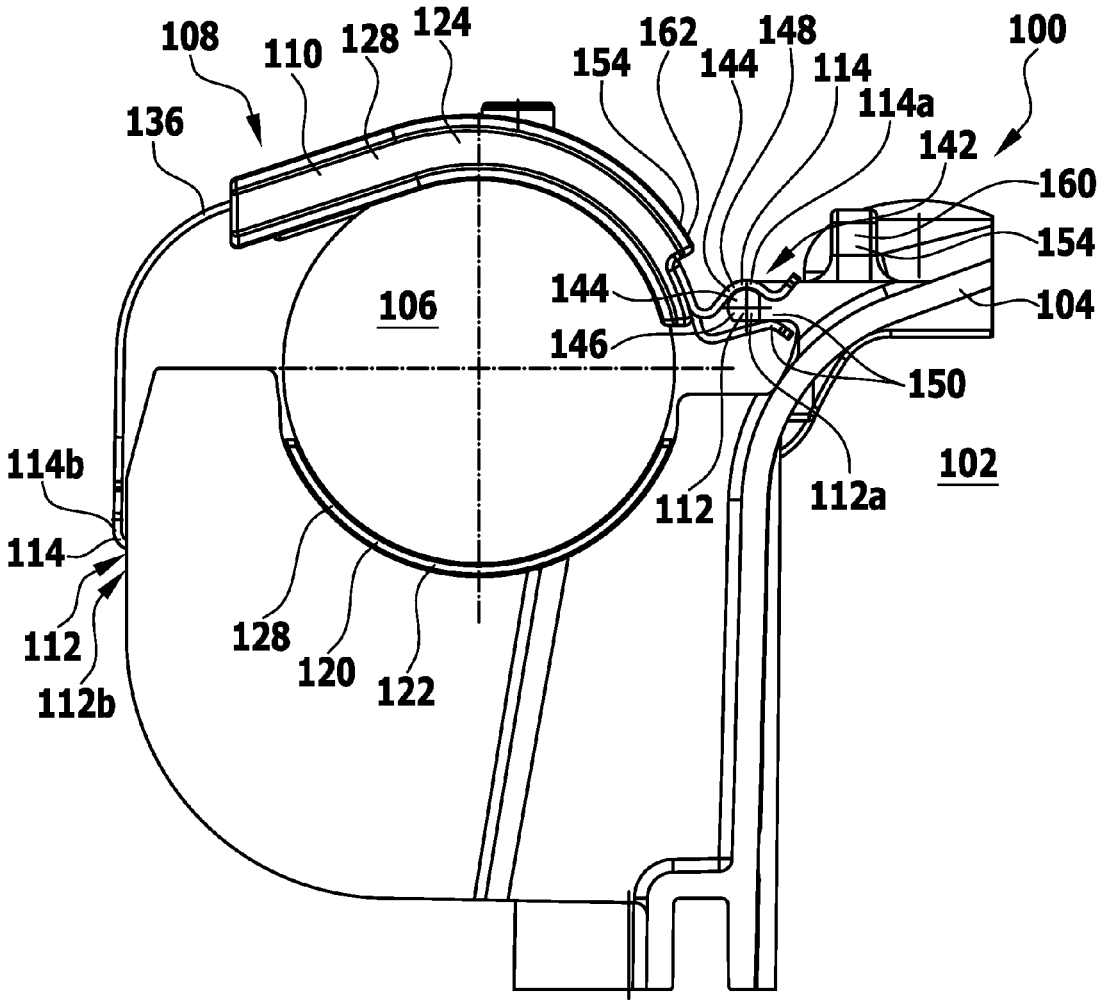
FIG. 12 shows a schematic cross section through the fixing device from FIG. 11.
Figure 13:
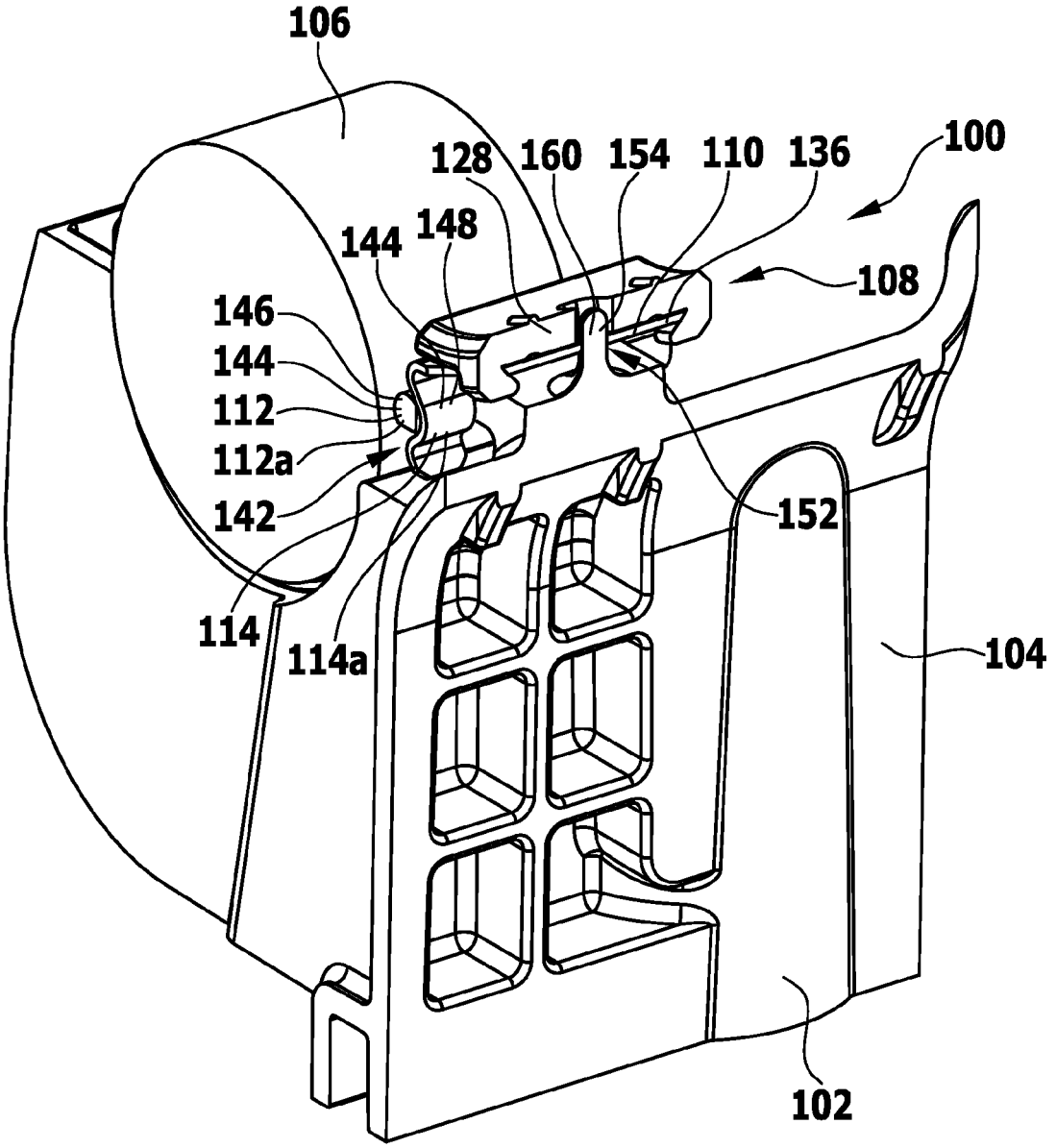
FIG. 13 shows a schematic longitudinal section through the fixing device from FIG. 11, wherein the fixing element is locked in an open position by means of a locking device.

A third embodiment of a valve cover 100 that is illustrated in FIGS. 11 to 13 differs from the first embodiment, which is illustrated in FIGS. 1 to 6, substantially in that one or more fixing devices 108 according to the embodiment illustrated in FIGS. 5 and 6 are provided, and additionally—in particular according to the embodiment in FIGS. 7 to 10—include a rotation device 142 and a locking device 152.

The fixing element 110 thus includes a metal bracket 136.

The first end region 114*a* of the fixing element 110 is shaped such that a rotation element 144, in particular a shaft receiver 148, and a locking element 154 are formed.

Here, the locking element 154 of the fixing element 110 is formed by two clamping elements 162 which can cooperate with a projection 160 on the base body 104 in order to lock the fixing element 110 in the open position.

Otherwise, the third embodiment of the valve cover 100 that is illustrated in FIGS. 11 to 13 corresponds regarding its construction and function to the first embodiment illustrated in FIGS. 1 to 6 and/or to the second embodiment illustrated in FIGS. 7 to 10, so reference is made to the description thereof above in this respect.

Figure 14:
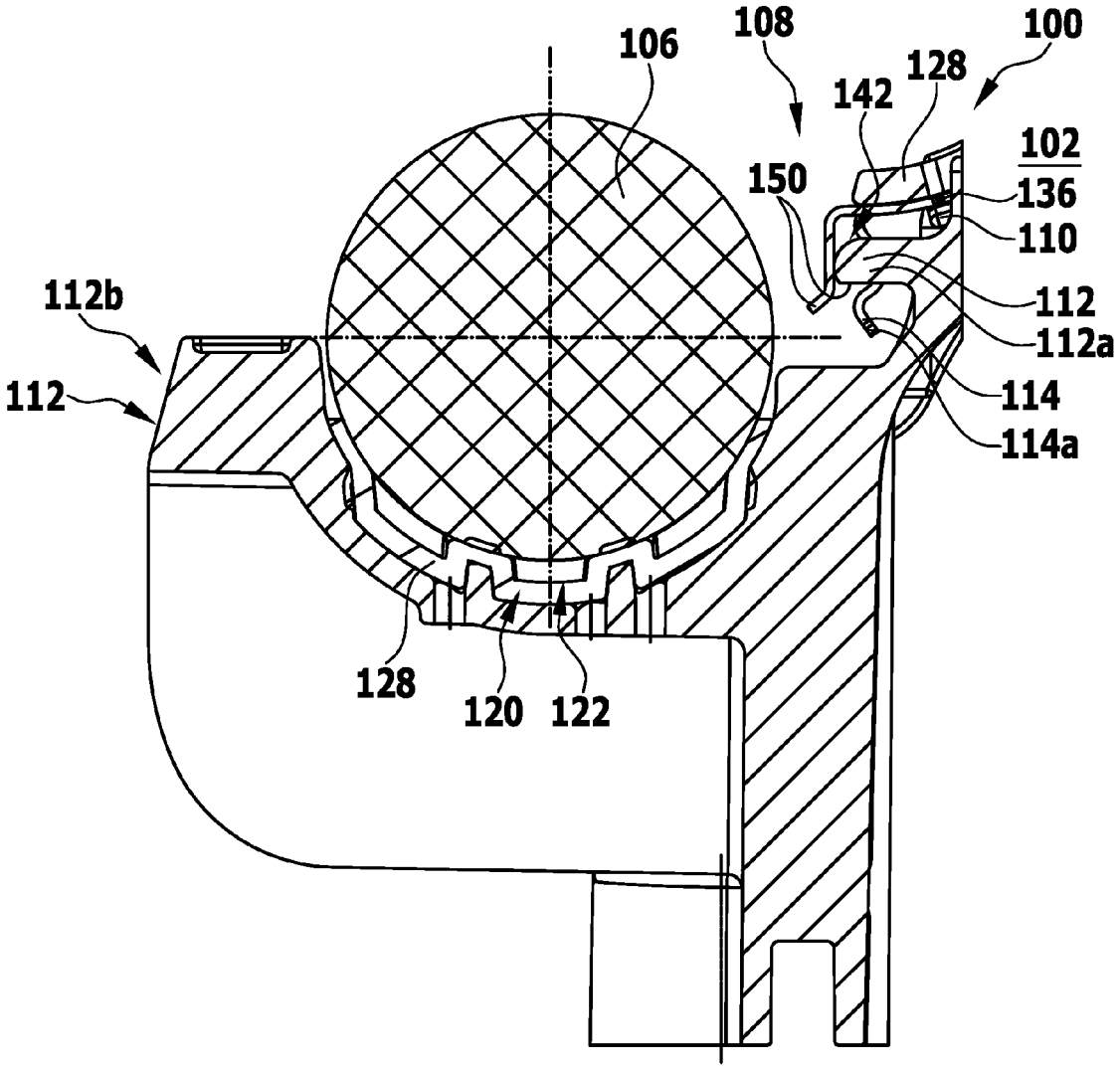
FIG. 14 shows a schematic cross section through a fixing device of a fourth embodiment of a valve cover, in which a fixing element is lockable in the open position by means of an alternative embodiment of a locking device.
Figure 15:
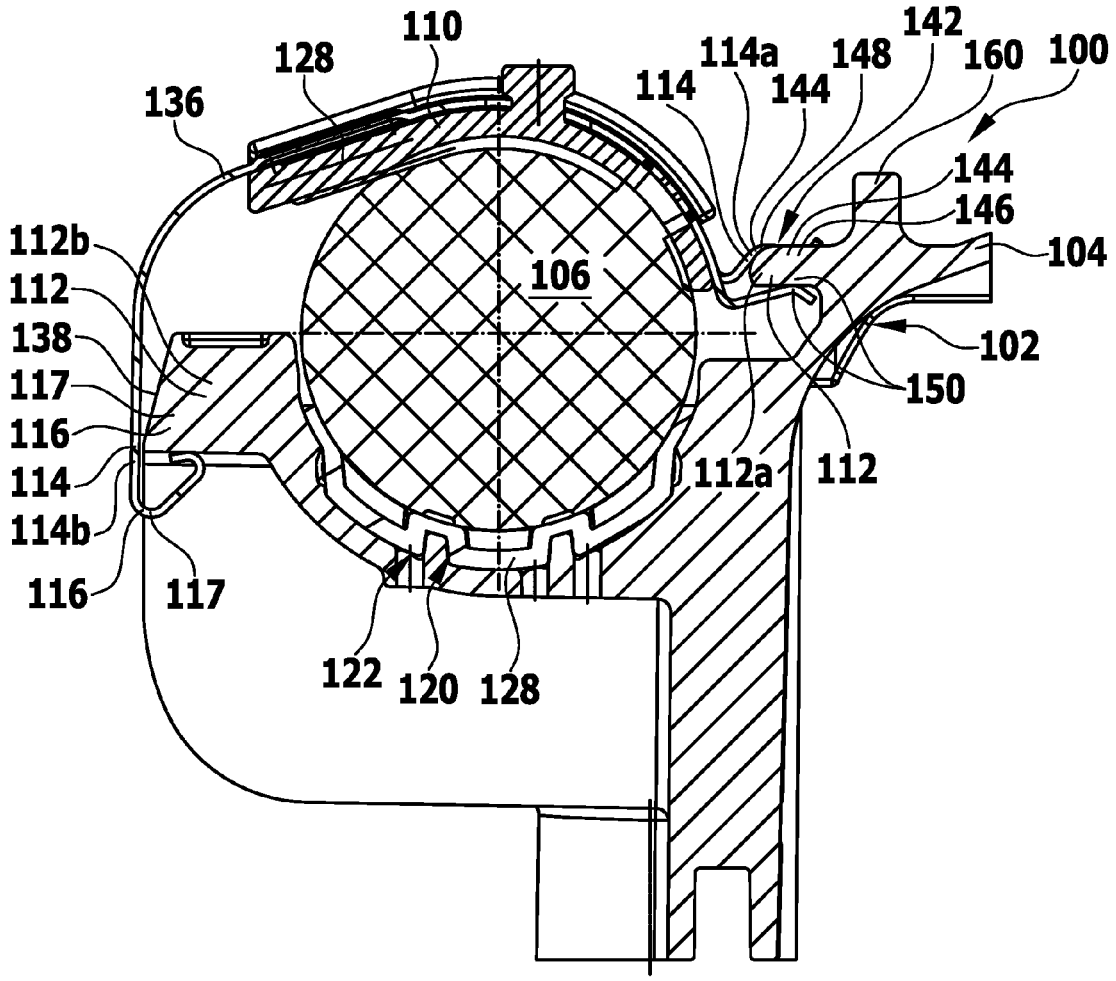
FIG. 15 shows a schematic cross section, corresponding to FIG. 10, through the fixing device from FIG. 14.

A fourth embodiment of a valve cover 100 that is illustrated in FIGS. 14 and 15 differs from the third embodiment, which is illustrated in FIGS. 11 to 13, substantially in that the locking device 152 includes only one clamping element 162, which cooperates with a projection 160 on the base body 104.

In the case of the embodiment illustrated in FIGS. 14 and 15, the locking is achieved by clamping the fixing element 110, in particular the rotation element 144 and the clamping element 162, between the rotation element 144 of the base body 104 and the projection 160 of the base body 104.

Otherwise, the fourth embodiment of the valve cover 100 that is illustrated in FIGS. 14 and 15 corresponds regarding its construction and function to the third embodiment illustrated in FIGS. 11 to 13, so reference is made to the description thereof above in this respect.

In the case of further embodiments (not illustrated) of valve covers 100, it may be provided for individual or a plurality of features of the embodiments described above to be combined with one another, in any desired manner.

Because a line 106 is securable by means of latchable fixing elements 110 in the case of all the embodiments of the valve cover 100, the line 106 may be secured to the valve cover 100 simply and by using a small number of fastening elements.

That which is claimed:

1. A valve cover, including the following:

a base body that, in a mounted condition of the valve cover, is arranged on an engine block of an internal combustion engine and covers over a valve chamber of the internal combustion engine;

at least one fixing device for securing at least one line to the base body of the valve cover, wherein the at least one fixing device includes at least one fixing element, a first fixing element receiver arranged on the base body, and a second fixing element receiver which is arranged on the base body and to which the at least one fixing element is securable by latching;

wherein the at least one fixing element is securable to the first fixing element receiver rotatably or pivotally such that the at least one fixing element can be rotated or pivoted in relation to the first fixing element receiver in order to engage with the second fixing element receiver.

2. The valve cover according to claim 1, wherein at least one fixing element receiver is molded within the base body.

3. The valve cover according to claim 1, wherein the at least one fixing device is movable without tools (i) from an open position, in which a line is arrangeable on the base body or is removable from the base body, to a closed position, in which the line is secured to the base body, or (ii) from the closed position to the open position or (iii) from the open position to the closed position and back to the open position.

4. The valve cover according to claim 1, wherein the at least one fixing device includes a locking device by means of which the at least one fixing element is releasably securable or releasably secured in an open position in which a line is arrangeable on the base body or is removable from the base body.

5. The valve cover according to claim 1, wherein the base body includes a receiving portion which has a shape that is complementary, at least in certain regions, to the shape of a portion of the at least one line.

6. The valve cover according to claim 1, wherein the base body includes a receiving portion that is formed as a receiving channel, for receiving at least one portion of the at least one line.

7. The valve cover according to claim 5, wherein the receiving portion is provided with an elastic material, at least in certain regions.

8. The valve cover according to claim 1, wherein the at least one fixing element has a shape that is complementary, at least in certain regions, to the shape of a portion of the at least one line.

9. The valve cover according to claim 1, wherein the at least one fixing element includes an elastic abutment element configured to abut the fixing element against the at least one line in a closed position.

10. The valve cover according to claim 1, wherein the at least one fixing element includes one or more plastics materials or is formed of one or more plastics materials.

11. The valve cover according to claim 1, wherein the at least one fixing element includes one or more metal materials or is formed of one or more metal materials.

12. The valve cover according to claim 1, wherein the first fixing element receiver includes a rotation element that, together with a rotation element of the at least one fixing element, forms a rotation device for rotary or pivotal securing of the fixing element to the first fixing element receiver.

13. The valve cover according to claim 12, wherein the first fixing element receiver includes a support element on which the at least one fixing element is supported in the closed position for transmitting a clamping force, wherein the support element is at least one of (i) an element other than the rotation element or (ii) a portion of the first fixing element receiver other than the rotation element.

14. The valve cover according to claim 1, wherein at least one of (i) the at least one fixing element or (ii) the second fixing element receiver includes a plurality of fixing portions configured to arrange the at least one fixing element in different closed positions for receiving lines of different dimensions.

* * * * *